US005551632A

United States Patent [19]

Kish et al.

[11] Patent Number: 5,551,632

[45] **Date of Patent: *Sep. 3, 1996**

[54] ELASTOMERIC PAD BETWEEN RAILROAD RAIL AND RAILROAD TIE

[75] Inventors: Frederick A. Kish, Wheeling; Herbert S. Golinkin, Naperville; Daniel C. Abt, Arlington Heights, all of Ill.

[73] Assignee: Illinois Tool Works Inc., Glenview, Ill.

[ * ] Notice: The term of this patent shall not extend beyond the expiration date of Pat. No. 5,551,633.

[21] Appl. No.: 472,303

[22] Filed: Jun. 7, 1995

Related U.S. Application Data

[63] Continuation-in-part of Ser. No. 333,522, Nov. 2, 1994.

[51] Int. Cl.[6] ..... E01B 9/62

[52] U.S. Cl. ..... 238/283

[58] Field of Search ..... 238/264, 265, 238/269, 283, 287

[56] References Cited

U.S. PATENT DOCUMENTS

| | | | |
|---|---|---|---|
| 1,772,875 | 8/1930 | O'Brien . | |
| 4,104,483 | 8/1978 | Seeley | 174/138 |
| 4,242,406 | 12/1980 | Bouhnini et al. | 428/236 |
| 4,313,563 | 2/1982 | Young | 238/349 |
| 4,325,511 | 4/1982 | Young | 238/349 |
| 4,494,463 | 1/1985 | Young et al. | 104/17 A |
| 4,540,637 | 9/1985 | Geary et al. | 428/626 |
| 4,566,631 | 1/1986 | Brown | 238/349 |
| 4,757,945 | 7/1988 | Leeves | 238/107 |
| 4,771,944 | 9/1988 | Brister et al. | 238/283 |
| 4,925,094 | 5/1990 | Buekett | 238/265 |
| 4,971,247 | 11/1990 | Harkus | 238/283 |
| 5,011,077 | 4/1991 | Hodgson et al. | 238/283 |
| 5,070,591 | 12/1991 | Quick et al. | 29/527.4 |
| 5,098,959 | 4/1992 | McGrath et al. | 525/299 |
| 5,110,046 | 5/1992 | Young | 238/283 |
| 5,165,346 | 11/1992 | Piekarski | 104/17.2 |
| 5,173,222 | 12/1992 | Young et al. | 264/35 |
| 5,195,679 | 3/1993 | Leeves et al. | 238/283 |
| 5,203,502 | 4/1993 | Young | 238/283 |
| 5,204,170 | 4/1993 | Kuyzin | 428/244 |
| 5,249,743 | 10/1993 | Leingang et al. | 238/283 |
| 5,261,599 | 11/1993 | Brown | 238/283 |
| 5,261,984 | 11/1993 | Minnick et al. | 156/209 |
| 5,346,131 | 9/1994 | Meier et al. | 238/283 |
| 5,405,081 | 4/1995 | Bosshart | 238/283 |

FOREIGN PATENT DOCUMENTS

| | | |
|---|---|---|
| 541884 | 5/1993 | European Pat. Off. . |
| 2086643 | 12/1971 | France . |
| 777189 | 6/1957 | United Kingdom . |
| 1496390 | 12/1977 | United Kingdom . |
| 1549623 | 8/1979 | United Kingdom . |
| 1554160 | 10/1979 | United Kingdom . |
| 2121461 | 12/1983 | United Kingdom . |
| 2237833 | 5/1991 | United Kingdom . |

*Primary Examiner*—S. Joseph Morano
*Attorney, Agent, or Firm*—Dressler, Goldsmith, Milnamow & Katz, Ltd.

[57] ABSTRACT

In a railroad track comprising a railroad rail having a lower flange, a railroad tie made from concrete, and a polyurethane pad mounted between the lower flange of the railroad rail and an upper surface of the railroad tie, a particulate layer is interposed between the polyurethane pad and the railroad tie and comprises particles bonded to the polyurethane pad. Preferably, the bonded particles are polycarbonate, acrylic, or nylon particles, either granules or fibers. Alternatively, the bonded particles are particles of quartz, silica sand, silicon carbide, or aluminum oxide. An adhesive layer is interposed between the polyurethane pad and the railroad tie, comprises a methacrylate ester composition, and is bonded to particles among the bonded particles and to the railroad tie, whereby the polyurethane pad and the railroad tie are bonded to one another via the particulate and adhesive layers.

20 Claims, 1 Drawing Sheet

ELASTOMERIC PAD BETWEEN RAILROAD RAIL AND RAILROAD TIE

CROSS-REFERENCE TO RELATED APPLICATION

This application is a continuation-in-part of U.S. Patent Application Ser. No. 08/333,522, which was filed on Nov. 2, 1994, and the disclosure of which is incorporated herein by reference.

TECHNICAL FIELD OF THE INVENTION

This invention pertains to an elastomeric pad, such as a polyurethane pad, which is mounted between a lower flange of a railroad rail and a railroad tie, for example a tie made of concrete. A particulate layer interposed between the elastomeric pad and the railroad tie is bonded to the elastomeric pad and an adhesive layer interposed between the elastomeric pad and the railroad tie is bonded to the particulate layer, whereby the elastomeric pad, the particulate layer, and the railroad tie are bonded to one another. Preferably, a methacrylate ester is used for the adhesive layer.

BACKGROUND OF THE INVENTION

Commonly, metal clips or clamps that engage embedded supports are used for securing steel railroad rails to concrete railroad ties, and non-conducting insulators are used to insulate the clips or clamps from the railroad rails. Metal clips or clamps of a type exemplified in Leeves U.S. Pat. No. 4,757,945, which when issued was assigned to Pandrol Limited of London, England, and metal clips or clamps of a type exemplified in Young U.S. Pat. No. 5,110,046, which when issued was assigned to McKay Australia Limited of Maidstone, Australia, are used widely in North America.

Commonly, when such clips are used, elastomeric pads are disposed between the lower flanges of the railroad rails and the railroad ties for cushioning the railroad rails and for insulating the rails electrically from the ties and from other underlying structures. Although ethylene vinyl acetate (EVA) rubber and other pads have been used widely for many years, polyurethane pads offering superior performance have become available commercially from ITW Irathane (a unit of Illinois Tool Works Inc.) of Hibbing, Minn., under its IRATHANE trademark.

Deterioration of the elastomeric pads and erosion of the concrete ties can occur if water infiltrates and freezes between the pads and the ties or if sand, which is used commonly to increase traction on grades, or debris infiltrates therebetween. Such deterioration and erosion problems can be quite severe, particularly under high loadings, in regions where weather conditions vary widely from summer to winter, at sharp curves, and at steep grades. Such deterioration and erosion problems can result in so-called "tie seat abrasion", which if severe can result in a railroad tie being judged unsafe for further service in a railroad track and having to be replaced.

Prior efforts to address such deterioration and erosion problems are disclosed in Buekett U.S. Pat. No. 4,925,094. As disclosed therein, a stainless steel or other non-corrodible metal or plastic plate is cast into an upper surface of a concrete tie. A rubber or plastic pad is interposed between the lower flange of a railroad rail and the plate that has been cast into the tie. The pad merely rests upon the plate and is free to move relative to the cast-in-place plate, held in place only by the clips.

Other efforts to address such deterioration and erosion problems are disclosed in Young U.S. Pat. No. 5,110,046. As disclosed therein, either an abrasion-resistant plate of an unspecified material is bonded to the upper surface of a concrete tie by an adhesive layer, epoxy resin adhesives being preferred, or a high density polyethylene (HDPE) closed cell foam is interposed between the abrasion-resistant plate and the upper surface of the concrete tie. In either instance, a rubber, polyurethane, or other elastomeric pad is interposed between the lower flange of a railroad rail and the upper surface of the concrete tie. Again the elastomeric pad merely rests upon the plate, held in place by clips, and is free to move relative to the adhesively bonded or foam-separated plate.

As a matter of related interest, Brown U.S. Pat. No. 5,261,599 discloses an elastomeric pad having resiliently deformable sealing portions, which are intended to form a watertight seal between the pad and the upper surface of a railroad tie, such as a concrete tie.

In U.S. patent application Ser. No. 08/333,522, supra, a composite pad is disclosed, which addresses such deterioration and erosion problems. The composite pad comprises an elastomeric pad, such as a polyurethane pad, to underlie the rail flange and a bonding member, such as a galvanized, organically coated, steel plate, or a rigid, polymeric film or sheet to overlie the railroad tie. An adhesive layer, for which a methacrylate ester composition is preferred, is employed for bonding the composite pad to the railroad tie. Preferably, a polyurethane pad is cast onto a steel plate, whereby the steel plate is bonded directly to the polyurethane pad. Because of differential shrinkage, however, it has been found that undesirable warpage of the composite plate can occur when a polyurethane pad is cast onto a steel plate or rigid, polymeric film or sheet.

SUMMARY OF THE INVENTION

Further addressing such deterioration and erosion problems but avoiding undesirable warpage, this invention contemplates that an elastomeric pad is mounted between the lower flange of the railroad rail and an upper surface of the railroad tie, that a particulate layer is interposed between the elastomeric pad and the railroad tie and comprises particles bonded to the elastomeric pad, and that an adhesive layer is interposed between the elastomeric pad and the railroad tie and is bonded to particles of the particulate layer and to the railroad tie, whereby the elastomeric pad and the railroad tie are bonded to one another via the particulate and adhesive layers.

Preferably, the elastomeric pad is a polyurethane pad, and the adhesive layer comprises a methacrylate ester composition. Preferably, the bonded particles are polycarbonate, acrylic, or nylon particles, either granules or fibers. Alternatively, the bonded particles are particles of quartz, silica sand, silicon carbide, or aluminum oxide.

These and other objects, features, and advantages of this invention are evident from the following description of two alternative embodiments of this invention with reference to the accompanying drawings.

DETAILED DESCRIPTION OF ILLUSTRATED EMBODIMENTS

Figure 1:
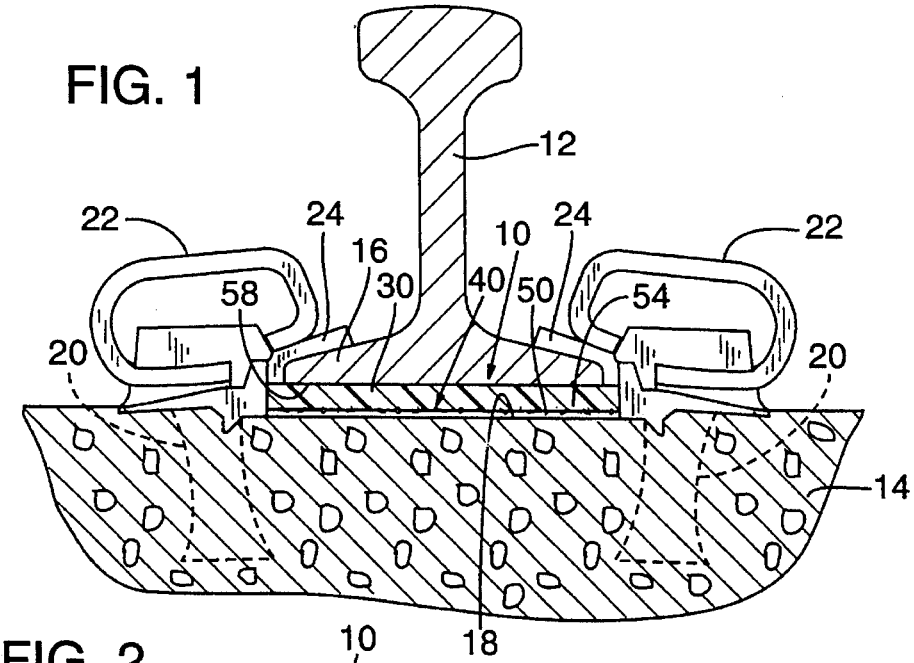
FIG. 1 is a fragmentary, cross-sectional view of a railroad rail having a lower flange, a railroad tie made from concrete, and a composite pad, together with associated clips, supports, and insulators, in a first embodiment of this invention.
Figure 2:
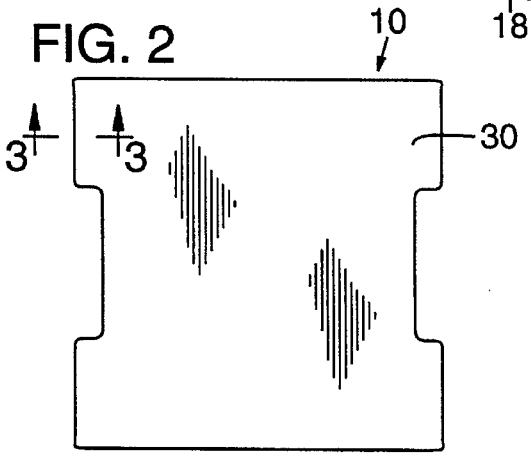
FIG. 2 is a plan view of the first embodiment shown in FIG. 1.
Figure 4:
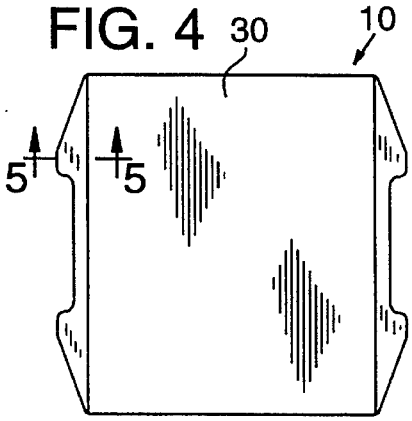
FIG. 4 is a plan view of a second embodiment of this invention.

As shown in FIG. 1 in a first embodiment of this invention, a composite pad 10 is mounted between a railroad rail 12 made from steel and a railroad tie 14 made from concrete. As mounted between a lower flange 16 of the railroad rail 12 and an upper surface 18 of the concrete tie 14, the composite pad 10 cushions the railroad rail 12 and insulates the railroad rail 12 electrically from the concrete tie 14.

Two supports 20 are embedded in the concrete tie 14 and extend upwardly from the upper surface 18. Two clamps 22 are provided, each engaging one of the supports 20 and pressing against one side of the lower flange 16 of the railroad rail 12, via an insulator 24 bearing on the composite pad 10, so as to secure the railroad rail 12 to the concrete tie 14.

Figure 3:
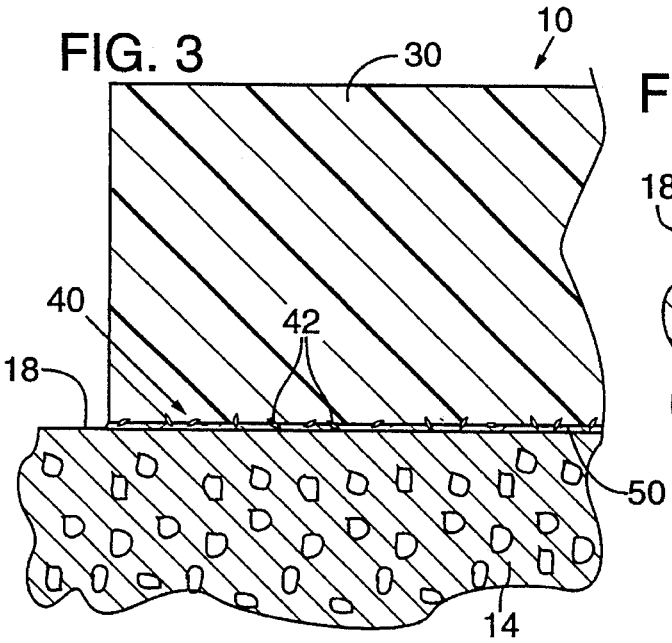
FIG. 3 is a greatly enlarged, fragmentary sectional view taken along line 3—3 of FIG. 2, in a direction indicated by arrows.
Figure 5:
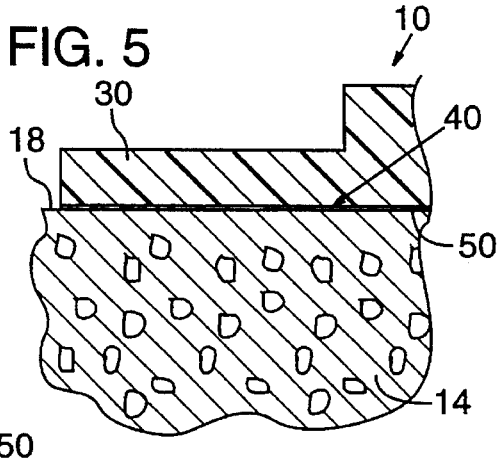
FIG. 5 is a somewhat enlarged, fragmentary sectional view taken along line 5—5 of FIG. 4, in a direction indicated by arrows.

In each illustrated embodiment, the composite pad 10 is configured so as to coact with metal clips or clamps known for securing railroad rails to railroad ties and comprises a polyurethane pad 30 and a particulate layer 40, which comprises particles bonded directly to the polyurethane pad 30 and which enable the polyurethane pad 30 to be adhesively bonded to the concrete tie 14. Preferably, the polyurethane pad 30 is a similar to the polyurethane pads that have become available commercially from ITW Irathane, supra, and is cast in an orientation that is inverted from its orientation in use (see FIGS. 3 and 5) except that the particles 42 of the particulate layer 40 are distributed onto the polyurethane pad 30, after such pad 30 has cured partially but before such pad 30 has cured completely, so that the particles 42 of the particulate layer 40 are bonded directly and chemically to the polyurethane pad 30, so that portions of the bonded particles 42 are embedded in the polyurethane pad 30, and so that portions of the bonded particles 42 are exposed.

Moreover, an adhesive layer 50 is used to bond the bonded particles 42 to the concrete tie 14, at the exposed portions of the bonded particles and the upper surface 18 of the concrete tie 14, so as to resist relative movement between the polyurethane pad 30 and the concrete tie 14 and so as to retard infiltration of sand, water, or debris between the polyurethane pad 30 and the concrete tie 14.

Preferably, the adhesive layer 50 in its uncured state is deposited on the upper surface 18 of the concrete tie 14, whereupon the composite pad 10 is pressed onto the adhesive layer 50 so as to spread the adhesive layer 50 until the adhesive layer 50 covers the lower surface of the polyurethane pad 30 and the exposed portions of the bonded particles 42. It is permissible for some of the adhesive layer 50 to be thus extruded beyond the margins of the polyurethane pad 30. Thereupon, the adhesive layer 50 is allowed to cure so that the adhesive layer 50 is bonded not only to the exposed portions of the particles 42 bonded to the polyurethane pad 30 but also to the concrete tie 14, whereby the composite pad 10 and the concrete tie 14 are bonded to one another via the particulate layer 40 and the adhesive layer 50.

Bonding between the adhesive layer 50 and the particles 42 of the particulate layer is a combination of chemical bonding and mechanical bonding. Mechanical bonding occurs because of interpenetration of the adhesive layer 50 and the particulate layer 40. It is not necessary, therefore, to have a strong bond between the polyurethane pad 30 and the adhesive layer 50.

Polymeric particles, either granules or fibers, or inorganic particles are suitable, so long as the adhesive composition selected for the adhesive layer 50 can be chemically or mechanically bonded to such particles. Thus, polycarbonate, acrylic, or nylon granules or polycarbonate, acrylic, or nylon fibers are suitable. Also, particles of quartz, silica sand, silicon carbide, or aluminum oxide may be so employed. Other polymeric or inorganic particles may prove to be also suitable.

As an example, polycarbonate pulverized to U.S. 20 Mesh may be distributed as granules by being shaken through a sieve or by being sprayed through a powder sprayer. As another example, granules of nylon 12 may be similarly distributed.

Preferably, the adhesive layer 50 is comprised of a methacrylate ester composition, namely the methacrylate ester composition disclosed in a copending application, U.S. patent application Ser. No. 08/310,709 (ITW Case 7046) which was filed on Sep. 21, 1994, by Fred A. Kish et al. for A METHACRYLATE ESTER COMPOSITION FOR ANCHORING MATERIALS IN OR TO CONCRETE OR MASONRY, which is assigned commonly herewith, and the disclosure of which is incorporated herein by reference.

Although the methacrylate ester composition discussed in the immediately preceding paragraph does not bond well to polyurethane, such as that used for the polyurethane pad 30, such methacrylate ester composition bonds chemically and mechanically to any of the polymeric particles discussed in the previously preceding paragraphs and at least mechanically to any of the inorganic particles discussed in the previously preceding paragraphs.

By this construction, any relative movement between the railroad rail 12 and the concrete tie 14 that is caused by a train rolling over the rail 12 will be between the bottom surface 58 of the rail flange 16 and the top surface 54 of the polyurethane pad 30.

Since the adhesive layer 50 is bonded to the concrete tie 14 below the composite pad 10 so as to retard infiltration of sand, water, or debris between the composite pad 10 and the concrete tie 14, the deterioration and erosion problems discussed above are alleviated, even under high loadings, in regions where weather conditions vary widely from summer to winter, at sharp curves, and at steep grades.

Various modifications may be made in the first and second embodiments described above without departing from the scope and spirit of this invention.

We claim:

1. In a railroad track, a combination comprising a railroad rail having a lower flange, a railroad tie, an elastomeric pad mounted between the lower flange of the railroad rail and an upper surface of the railroad tie, the elastomeric pad being in direct contact with the lower flange of the railroad rail, and means comprising a particulate layer and an adhesive layer for bonding the elastomeric pad to the railroad tie, the particulate layer being interposed between the elastomeric pad and the railroad tie and comprising particles bonded to the elastomeric pad, the adhesive layer being interposed between the elastomeric pad and the railroad tie and bonded to particles among the bonded particles and to the railroad tie, whereby the elastomeric pad and the railroad tie are bonded to one another via the particulate and adhesive layers so as to resist relative movement between the elastomeric pad and the railroad tie, the combination permitting relative movement between the railroad rail and the elastomeric pad.

2. The combination of claim 1 wherein the bonded particles are polymeric particles.

3. The combination of claim 2 wherein the bonded particles are polymeric granules.

4. The combination of claim 3 wherein the bonded particles are polycarbonate, acrylic, or nylon granules.

5. The combination of claim 2 wherein the bonded particles are polymeric fibers.

6. The combination of claim 5 wherein the bonded particles are polycarbonate, acrylic, or nylon fibers.

7. The combination of claim 1 wherein the bonded particles are inorganic particles.

8. The combination of claim 7 wherein the bonded particles are particles of quartz, silica sand, silicon carbide, or aluminum oxide.

9. The combination of claim 1 wherein the adhesive layer is bonded mechanically to particles among the bonded particles.

10. The combination of claim 1 wherein the adhesive layer is bonded chemically to particles among the bonded particles.

11. In a railroad track, a combination comprising a railroad rail having a lower flange, a railroad tie, a polyurethane pad mounted between the lower flange of the railroad rail and an upper surface of the railroad tie, the polyurethane pad being in direct contact with the lower flange of the railroad rail, and means comprising a particulate layer and an adhesive layer for bonding the polyurethane pad to the railroad tie, the particulate layer being interposed between the polyurethane pad and the railroad tie and comprising particles bonded to the polyurethane pad, the adhesive layer being interposed between the polyurethane pad and the railroad tie and being bonded to particles among the bonded particles and to the railroad tie, whereby the polyurethane pad and the railroad tie are bonded to one another via the particulate and adhesive layers so as to resist relative movement between the polyurethane pad and the railroad tie, the combination permitting relative movement between the railroad rail and the polyurethane pad.

12. The combination of claim 7 wherein the bonded particles are polymeric particles.

13. The combination of claim 12 wherein the bonded particles are polymeric granules.

14. The combination of claim 13 wherein the bonded particles are polycarbonate, acrylic, or nylon granules.

15. The combination of claim 12 wherein the bonded particles are polymeric fibers.

16. The combination of claim 15 wherein the bonded particles are polycarbonate, acrylic, or nylon fibers.

17. The combination of claim 11 wherein the bonded particles are inorganic particles.

18. The combination of claim 17 wherein the bonded particles are particles of quartz, silica sand, silicon carbide, or aluminum oxide.

19. The combination of claim 11 wherein the adhesive layer is bonded mechanically to particles among the bonded particles.

20. The combination of claim 11 wherein the adhesive layer is bonded chemically to particles among the bonded particles.

* * * * *